United States Patent [19]

Kamata

[11] Patent Number: 4,807,376

[45] Date of Patent: Feb. 28, 1989

[54] TROUSER PRESSER HAVING VERTICALLY AND HORIZONTALLY MOVABLE CARRIER

[75] Inventor: Shigeru Kamata, Moriyama, Japan

[73] Assignee: Fuji Car Mfg. Co., Ltd., Osaka, Japan

[21] Appl. No.: 92,359

[22] Filed: Sep. 2, 1987

[30] Foreign Application Priority Data

Sep. 19, 1986 [JP] Japan ..... 61-222796

[51] Int. Cl.[4] ..... D06F 71/28

[52] U.S. Cl. ..... 38/42; 223/73

[58] Field of Search ..... 223/73, 63; 38/42, 43, 38/25

[56] References Cited

U.S. PATENT DOCUMENTS 3,823,854 7/1974 Everett ..... 223/73
4,349,137 9/1982 Everett ..... 223/73
4,473,961 10/1984 Frushtick ..... 223/73

*Primary Examiner*—Andrew M. Falik
*Attorney, Agent, or Firm*—Armstrong, Nikaido, Marmelstein & Kubovcik

[57] ABSTRACT

A trouser presser includes a trouser carrier for holding a pair of washed trousers in a desired attitude. The trouser carrier includes a waist pad for receiving the waist portion of the trousers to shape it and a bottom stretcher for receiving the bottoms of the trousers to stretch them. Heat plates are provided for pressing from both sides the pair of washed trousers to dry them. A first drive is provided for moving the trouser carrier up and down, and a second drive for horizontally reciprocating the trouser carrier between a trouser loading position and a trouser press position. The second drive includes a horizontal guide rod, an arm base slidably mounted on the guide rod, a pair of arms having one end thereof pivotally mounted on the arm base and the other end thereof pivotally mounted on the trouser carrier, a guide rail extending substantially in parallel with the guide rod and having one end portion thereof bent at a predetermined angle, a restriction plate fixedly mounted on one of the arms at its end portion near the arm base at a predetermined angle with respect to the arms, and a pair of rollers mounted on both ends of the restriction plate and rollingly received in the guide rail, for causing the trouser carrier to be swung by an angle corresponding to the bent angle of the guide rail when the rollers move along the elbow portion of the guide rail and to move substantially in a straight line when the rollers move along the straight portion of the guide rail.

2 Claims, 6 Drawing Sheets

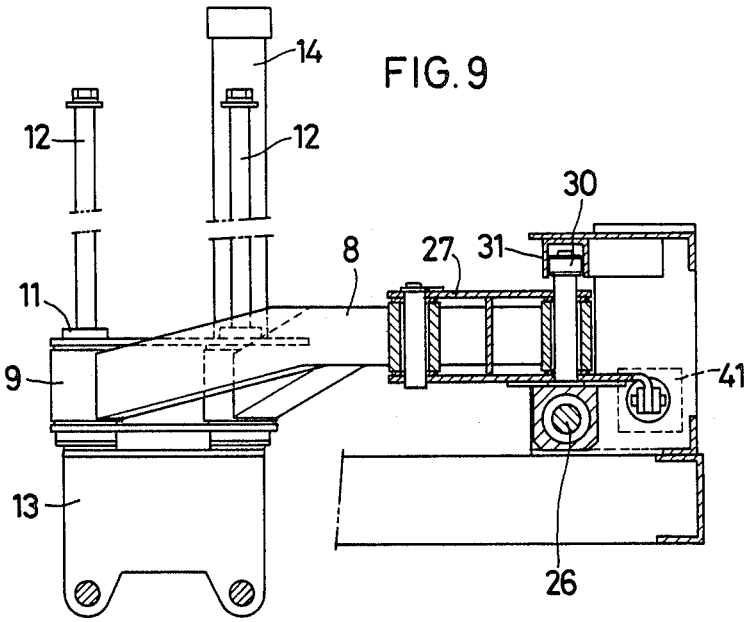
FIG. 9
FIG. 10
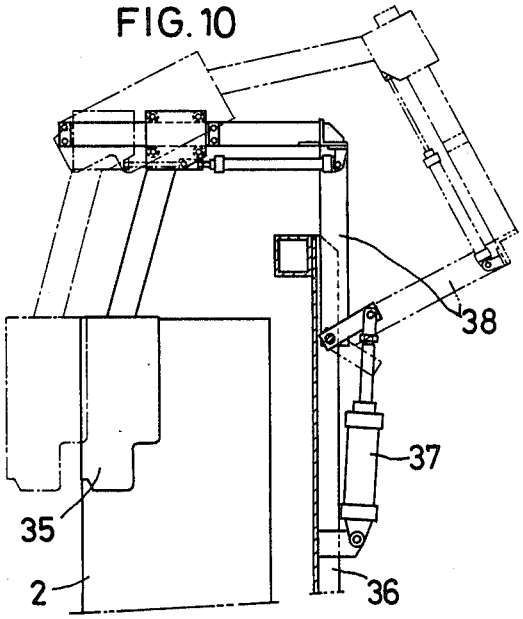

TROUSER PRESSER HAVING VERTICALLY AND HORIZONTALLY MOVABLE CARRIER

BACKGROUND OF THE INVENTION

The present invention relates to a trouser presser for drying and pressing a pair of washed trousers.

A conventional trouser presser of this type comprises a trouser carrier for holding or hanging a pair of washed trousers in a good shape, and heat plates for pressing the trousers from both sides fitted on the trouser carrier. The trouser carrier comprises a waist pad for shaping the waist portion of the trousers and bottom stretchers adapted to be fitted into the trouser bottoms to adjust their creases.

In fitting the trousers on the trouser carrier, the waist portion is firstly fitted on the waist pad, and the bottom stretchers are then inserted into their bottoms while adjusting their creases. After checking to make sure that there is no waviness on the surface of the trousers, which would result in wrinkles after pressing, a press start button is pressed. If any waviness is recognized on the trousers, it is necessary to adjust the mounting position of the waist pad and/or bottom stretchers to correct such an improper fitting.

It will be readily understood from the above description that the operator has to stoop down at least once to fit the waist portion and the bottoms for each pair of trousers. The faster the speed of the trouser presser, the more frequently the operator has to stoop down. Thus an increasing number of presser operators complain of tiredness or a pain in the waist.

SUMMARY OF THE INVENTION

It is an object of the present invention to provide a trouser presser which obviates the abovesaid shortcomings and which enables the operator to fit trousers without stooping down.

In accordance with the present invention, there is provided a trouser presser in which trouser carriers are adapted to be raised and lowered. Since the operator can freely raise or lower the trouser carriers, depending on whether he works at the waist portion or the bottom portion, when fitting trousers or correcting the fitting condition, the operator himself does not have to stoop down to do the fitting job.

BRIEF DESCRIPTION OF THE DRAWINGS

Other features and objects of the present invention will become apparent from the following description taken with reference to the accompanying drawings, in which:

FIG. 9 is a central sectional rear view of the transfer means;

FIG. 10 is a side view of hot plates for the front waist portion of trousers.

DETAILED DESCRIPTION OF A PREFERRED EMBODIMENT

Now an embodiment of the trouser presser according to the present invention will be described with reference to the drawings.

Figure 1:
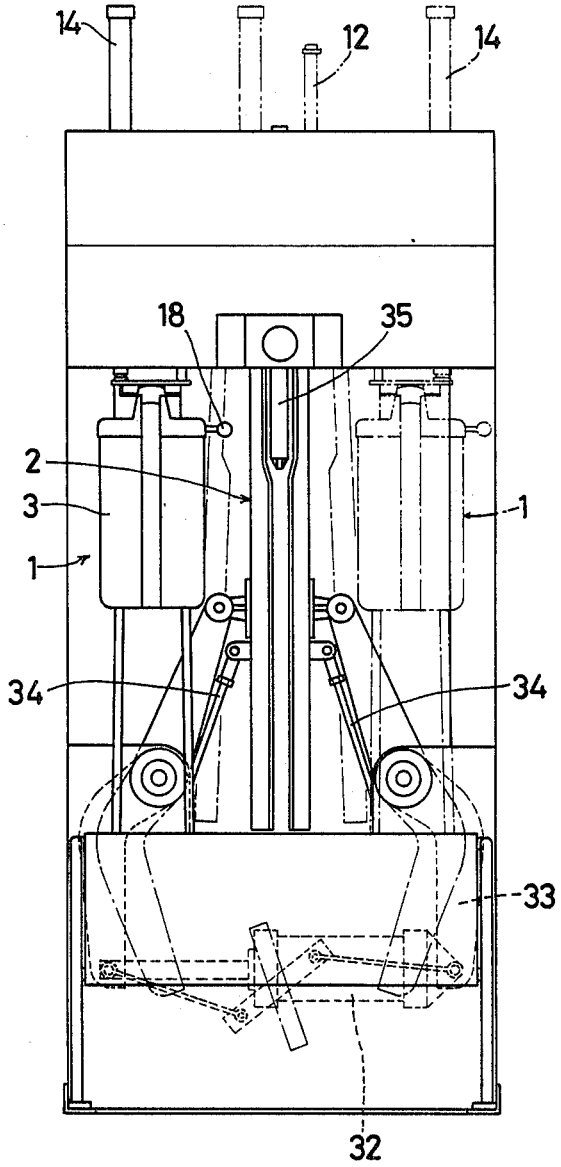
FIG. 1 is a front view of the trouser presser in accordance with the present invention in the position for pressing.
Figure 11:
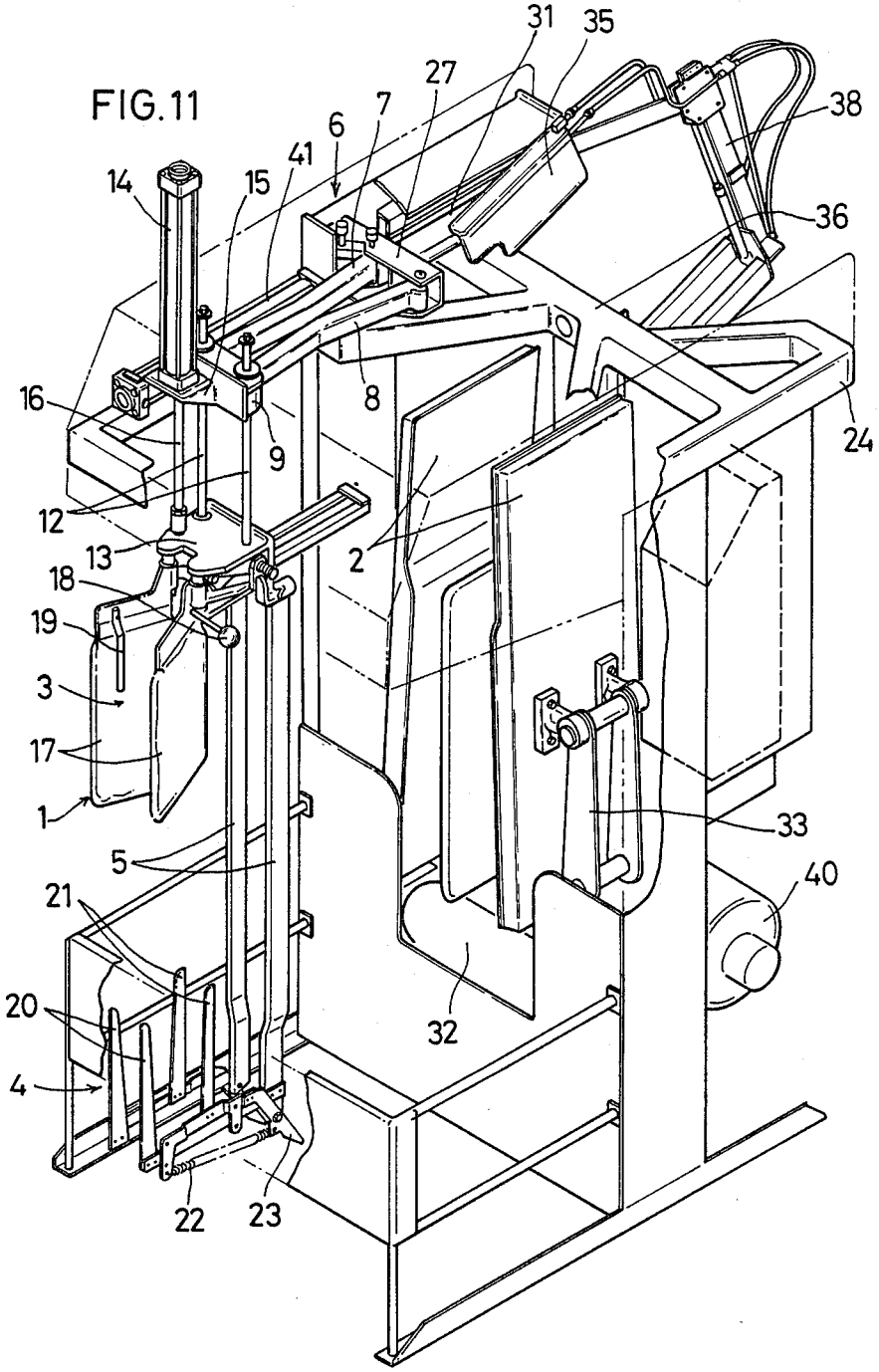
FIG. 11 is a perspective view of the trouser presser of the instant invention.

The trouser presser is, as best shown in FIG. 1, and FIG. 11 provided with an opposed pair of trouser carriers 1 at its front side, and heat plates 2 disposed at rear center for pressing a pair of trousers A (FIGS. 4 and 5) carried by the trouser carriers 1 from both sides. The trouser carriers 1 are alternately transferred into between the heat plates 2 located in their rear to press the trousers.

The trouser carriers 1 each comprise a waist pad 3 adapted to be fitted in the waist portion of the trousers to shape the same and a bottom stretcher 4 adapted to be fitted into the bottoms of the trousers to adjust the creases. The waist pad 3 and the bottom stretcher 4 are mounted on a guide pipe 5 at its upper and lower parts, respectively.

Figure 6:
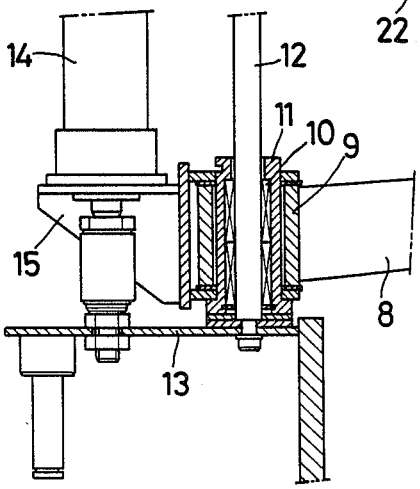
FIG. 6 is a partial sectional view of the upper part of the trouser carrier.

Each trouser carrier 1 is vertically movably suspended from one end of a pair of arms 7, 8 (FIGS. 7 and 8) of a transfer mechanism 6 to shuttle the trouser carrier 1 between the loading position and the press position. Each of the arms 7, 8 is provided at its end with a cylindrical support tube 9 in which a bearing 11 having linear ball bearings 10 (FIG. 6) is rotatably mounted An elevator rail 12 vertically slidably extends through the bearing 11 and has its lower end secured to a waist pad base 13 mounted on the top of the trouser carrier 1. A mounting base 15 of an elevator cylinder 14 has its rear end fixed to the outer periphery of the bearing 11 having its upper and lower ends protruding beyond the support tube 9. (FIG. 6) The elevator cylinder 14 is mounted on the mounting base 15 with its rod 16 extending downwardly and having its lower end fixed to the waist pad base 13 as shown in FIG. 6. By extending the rod 16 of the elevator cylinder 14, the entire trouser carrier 1 descends, guided by the elevator rail 12. Telescoping the rod 16 will raise the entire trouser carrier 1.

Each waist pad 3 comprises an opposed pair of pad plates 17 (FIGS. 7 and 8) having their front ends normally spaced apart from each other and adapted to be biased open by leaf spring 19 (FIGS. 4 and 5) and to be closed by the action of the heat plates 2. Lever 18 operates to allow balloon 17' to inflate.

The pad plate 17 is covered with a balloon (not shown) into which hot air is blown from nozzle 39 when the trouser carrier is in its press position The bottom stretcher 4 comprises a pair of stretcher plates 20, 21 for holding the front and rear of each trouser bottom. (FIG. 5) The rear stretcher plate 21 is normally biased by a spring 22 backwardly, i.e. in a direction away from the front stretcher plate 20 and is adapted to be moved toward and away from the plate 20. At the lower end of the guide pipe 5 is mounted a locking lever 23 for locking the rear stretcher plate 21 in its closed position close to the front plates 20. When the locking lever 23 is released, the rear stretcher plate 21 will move backward away from the front one 20 by the urging of the spring 22.

Figure 2:
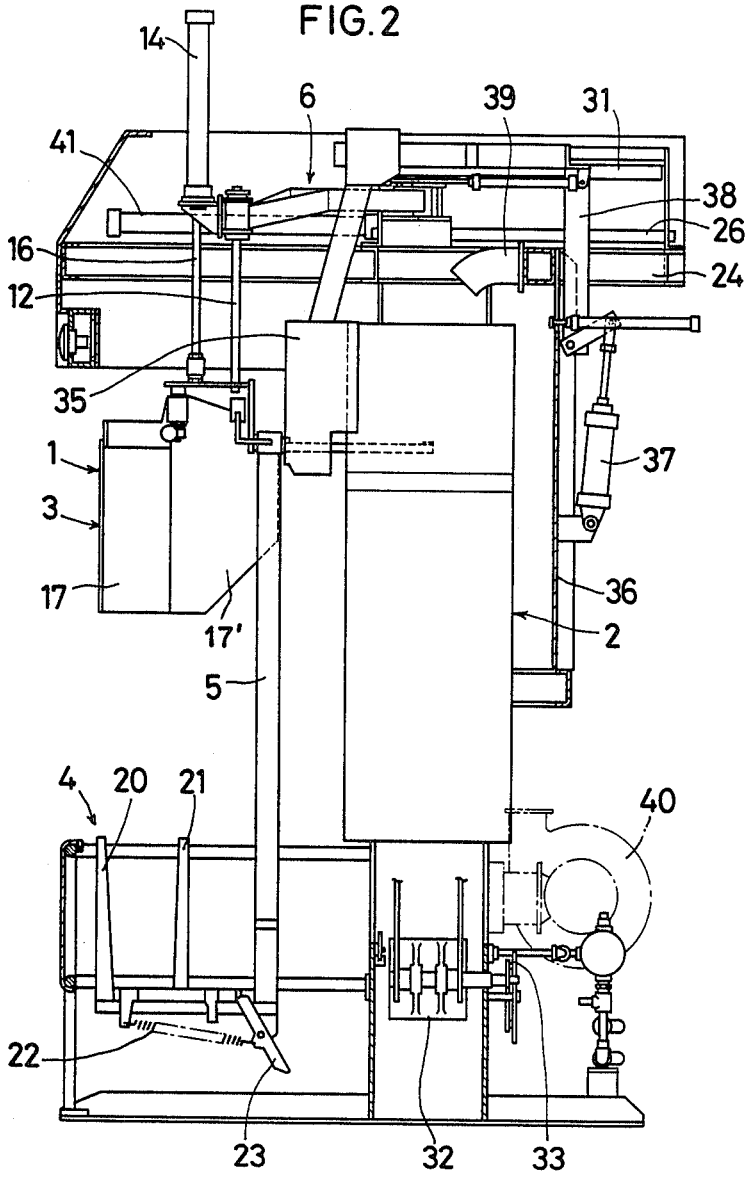
FIG. 2 is a central sectional view of the same with the trouser carrier in its trouser fitting position.
Figure 3:
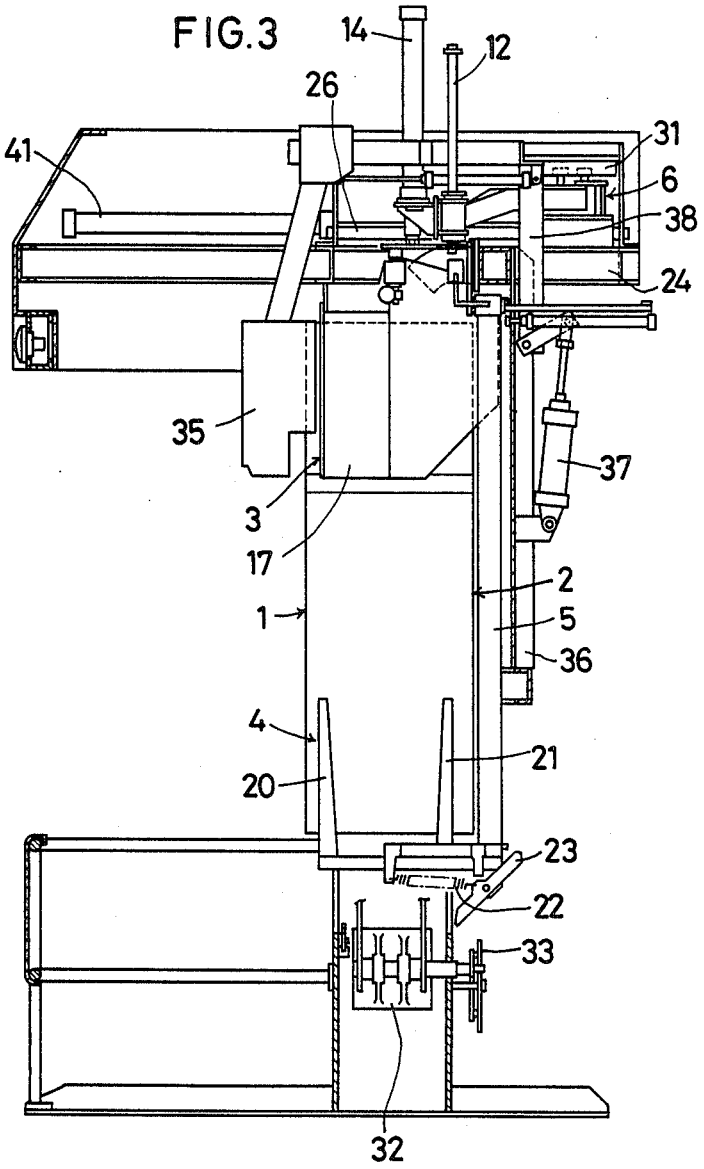
FIG. 3 is a central sectional view of the same with the trouser carrier in its pressing position.

Next, the transfer mechanism 6 for moving the trouser carriers 1 between the trouser fitting position and the press position (FIG. 3) will be described. A pair of upright plates 25 (FIGS. 7 and 8) are provided on each side of the upper surface of a frame 24 (FIG. 2) of the trouser presser. A guide rod 26 (FIG. 9) extends between the upright plates 25. An arm base 27 (FIGS. 7, 8 and 9) is slidably mounted on the guide rod 26 so as to be moved back and forth between the upright plates 25 by a cylinder 41 mounted to the front upright plate 25. Two arms 7, 8 (FIGS. 7 and 8) for suspending the trouser carrier 1 have their rear end pivotally mounted on the arm base 27. The outer arm 7 is provided on its rear upper surface with a restriction plate 28 which extends outwardly and forwardly at an angle of about 45 degrees with respect to the arm 7 and is provided with guide rollers 29, 30 on its upper surface at both ends The guide rollers 29, 30 are mounted in a guide rail 31 provided over and along the guide rod 26 extending between the upright plates 25. The guide rail 31 has its front end portion bent outwardly by about 45 degrees.

Figure 7:
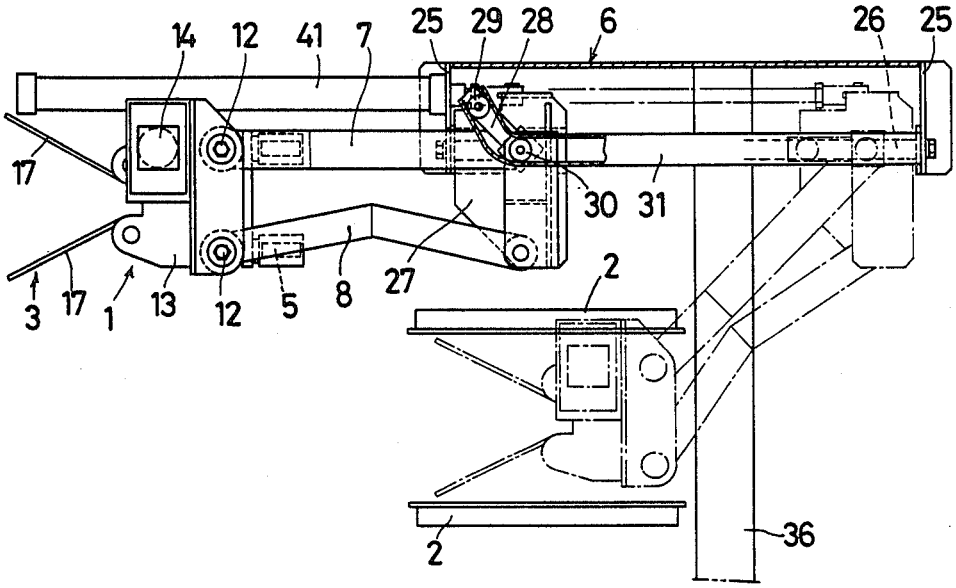
FIGS. 7 and 8 are plan views of a transfer means.
Figure 8:
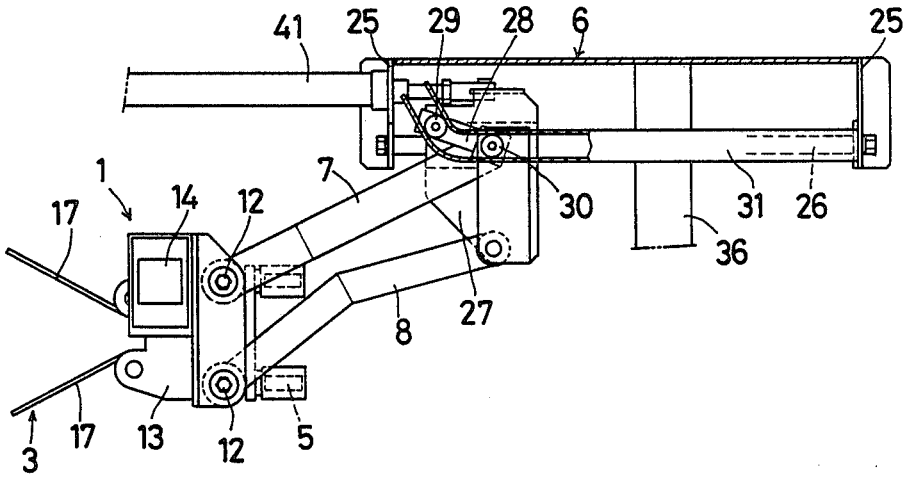

When the arm base 27 is in its front position, the guide rollers 29, 30 provided at both ends of the restriction plate 28 are in the front elbow portion of the guide rail 31, while the arms 7, 8 are parallel to the guide rod 26, so that the trouser carrier 1 is located outside, as shown by full lines in FIG. 7. When the cylinder 41 is driven to slightly move the arm base 27 rearwardly, the guide rollers 29, 30 are moved from the elbow portion of the guide rail 31 to its straight portion, turning the restriction plate 28 inwardly until it becomes parallel with the guide rail 31 as shown in FIG. 8. With the turn of the restriction plate 28, the arm 7 is turned inwardly to send the trouser carrier 1 inside. Further driving the cylinder 41 to move the arm base 27 backwardly will cause the guide rollers 29, 30 to be pushed to the rear of the straight portion of the guide rail 31, so that the restriction plate 28 moves backwardly, keeping its parallel position with the guide rail 31 until the trouser carrier 1 is received between the opposite heat plates 2 as shown by chain lines in FIG. 7. Additionally because of the aforementioned construction the trouser carrier remains in a generally parallel position with respect to the guide rod 26 as shown in FIG. 7.

The opposite heat plates 2 are opened and closed by a press cylinder 32 (FIG. 1) through press arms 33. At the rear of the heat plates 2 is provided a tie rod 34 for parallel displacement of the heat plates 2.

As shown in FIG. 10, another heat plate 35 for pressing the front waist portion of the trousers is provided above the opposite heat plates 2. Driven by a cylinder 37 provided at the rear of a frame 36 through a link mechanism 38, the heat plate 35 is lowered from its uppermost position until it is received between the upper parts of the heat plates 2 to press the front waist portion of the trousers.

Figure 4:
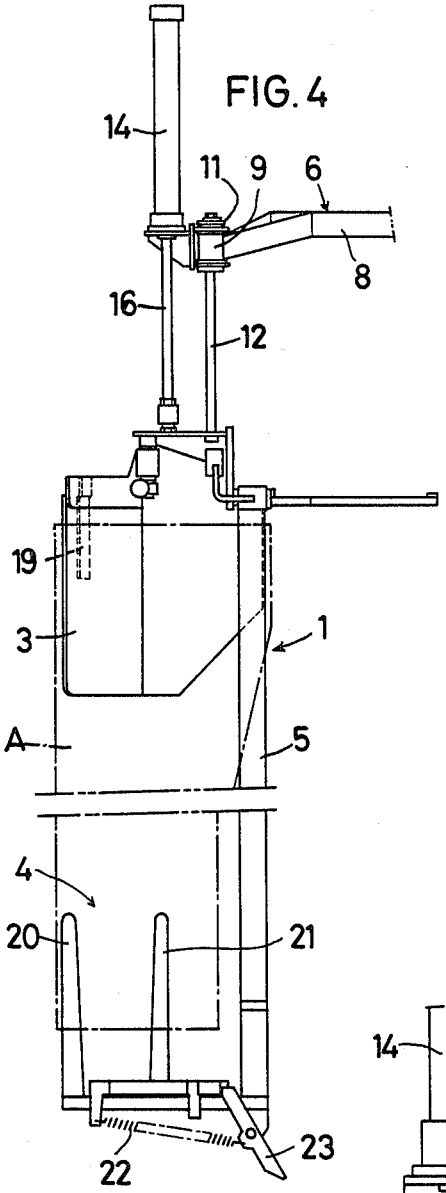
FIG. 4 is a side view of the trouser carrier in its lowermost position.

The above-described trouser presser is operated as follows:

The operator firstly fits the waist portion of the trouser A on the waist pad 3 of the trouser carrier 1 with the rod 16 of the elevator cylinder 14 extended downwardly, i.e. with the entire trouser carrier 1 at the lowest position as shown in FIG. 4. When the fitting of the waist portion is complete, the rod 16 is retracted into the elevator cylinder 14 to raise the trouser carrier 1 into the position shown in FIG. 5. The bottom stretcher 4 is then inserted into the bottoms of the trousers A while adjusting their creases. In doing this, the front and rear stretcher plates 20, 21 are held close to each other with the rear stretcher 21 locked by the locking lever 23. After both the stretchers 20, 21 have been inserted into the bottoms of the trousers, the locking lever 23 is released to move the rear stretcher 21 away from the front one 20 and stretch the bottoms of the trousers. If it is necessary to correct any improper fitting such as waviness on the trouser surface, correction can be made while moving the entire trouser carrier 1 up and down by controlling the cylinder 14 until the trousers are fitted snugly.

Figure 5:
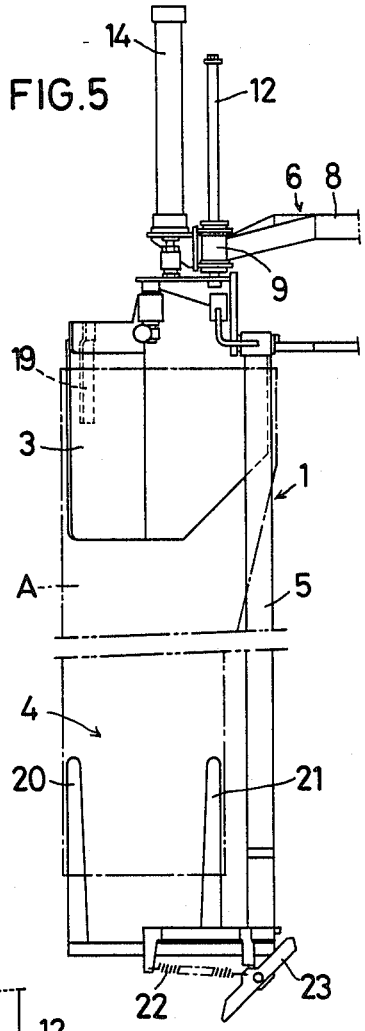
FIG. 5 is a side view of the same in its uppermost position.

Upon completion of fitting, with the trouser carrier 1 raised to its upper position shown in FIG. 5, the cylinder 41 is actuated to move the trouser carrier 1 backward into its press position, where an air supply port of the balloon covering the waist pad 3 of the trouser carrier 1 fits into a hot air outlet 39 (FIG. 2) provided over and at the rear of the heat plates 2 and hot air is blown into the balloon from a blower 40 to inflate and dry the trousers. At the same time, the press cylinder 32 for the heat plates 2 and the cylinder 37 for the heat plate 35 for the front waist portion are actuated to press the trousers fitted on the trouser carrier 1.

When completion of the pressing is detected by means of a press timer or a humidity sensor with a thermal compensator, the supply of hot air stops while the trouser carrier 1 is released from the heat plates 2 and the heat plate 35 for the front waist portion to return to the fitting position. Next, the locking lever 23 is locked to shorten the distance between the bottom stretcher plates 20, 21, thus allowing the trousers A to be removed from the stretcher 4. The rod 16 of the elevator cylinder 14 is then stretched to lower the trouser carrier 1 and remove the waist portion of the trousers from the waist pad 3. The trouser carrier 1 is now prepared to fit another pair of trousers.

The above said operation steps may be carried out automatically.

What are claimed are:

1. A trouser presser, comprising:

a trouser carrier for holding a pair of washed trousers in a desired attitude, said trouser carrier including a waist pad for receiving the waist portion of the trousers to shape it and a bottom stretcher for receiving the bottoms of the trousers to stretch them;

heat plates for pressing from both sides said pair of washed trousers to dry them;

a first drive means for moving said trouser carrier up and down, and a second drive means for horizontally reciprocating said trouser carrier between a trouser loading position and a trouser press position, said second drive means including, (a) a horizontal guide rod, (b) an arm base slidably mounted on said guide rod, (c) a pair of arms each having one end thereof pivotally mounted on said arm base and the other end thereof pivotally mounted on said trouser carrier, (d) a guide rail having a straight portion extending substantially in parallel with said guide rod and having one end portion thereof bent at a predetermined angle comprising an elbow portion, (e) a restriction plate fixedly mounted on one of said arms at its end portion near said arm base at a predetermined angle with respect to said arms, and (f) a pair of roller means mounted on both ends of said restriction plate and rollingly received in said guide rail, for causing said trouser carrier to be swung by an angle corresponding to the bent angle of said guide rail when said roller means moves along the elbow portion of said guide rail and to move substantially in a straight line when said roller means moves along the straight portion of said guide rail, wherein the carrier maintains a generally parallel relationship with respect to said guide rod.

2. A trouser presser as claimed in claim 1, wherein said first drive means is a cylinder having a rod, said trouser carrier being fixedly mounted on said rod.

* * * * *